US009415993B2

(12) United States Patent
Thibodeaux et al.

(10) Patent No.: US 9,415,993 B2
(45) Date of Patent: Aug. 16, 2016

(54) SYSTEMS AND METHODS FOR DISPENSING ONE OR MORE BEVERAGES

(71) Applicants: Kevin Kinslow Thibodeaux, Dallas, TX (US); David Gregory Gill, Azle, TX (US)

(72) Inventors: Kevin Kinslow Thibodeaux, Dallas, TX (US); David Gregory Gill, Azle, TX (US)

(73) Assignee: Kevin K. Thibodeaux, Dallas, TX (US)

( * ) Notice: Subject to any disclaimer, the term of this patent is extended or adjusted under 35 U.S.C. 154(b) by 229 days.

(21) Appl. No.: 14/073,843

(22) Filed: Nov. 6, 2013

(65) Prior Publication Data

US 2014/0124094 A1 May 8, 2014

Related U.S. Application Data

(60) Provisional application No. 61/723,318, filed on Nov. 7, 2012.

(51) Int. Cl.

| | |
|---|---|
| ***B67C 3/34*** | (2006.01) |
| ***B67D 1/02*** | (2006.01) |
| ***B67D 1/06*** | (2006.01) |
| *B67D 1/07* | (2006.01) |
| *B67D 1/08* | (2006.01) |
| *B67D 1/12* | (2006.01) |

(52) U.S. Cl.

CPC *B67D 1/025* (2013.01); *B67D 1/06* (2013.01); *B67D 1/07* (2013.01); *B67D 1/0857* (2013.01); *B67D 1/1202* (2013.01); *B67D 2210/00047* (2013.01); *B67D 2210/00112* (2013.01)

(58) Field of Classification Search

CPC ..... B67D 1/025; B67D 1/0418; B67D 1/06; B67D 1/07; B67D 1/0857; B67D 1/1202; B67D 2210/00112

USPC ..... 141/5, 64, 263, 264, 301, 374; 222/523

See application file for complete search history.

(56) References Cited

U.S. PATENT DOCUMENTS

| | | | | |
|---|---|---|---|---|
| 4,572,230 | A * | 2/1986 | Mirabile | B08B 9/0325 134/166 C |
| 4,633,678 | A * | 1/1987 | Lea | B67D 1/0857 220/592.19 |
| 4,802,344 | A * | 2/1989 | Livingston | A45F 3/16 62/372 |
| 5,564,568 | A * | 10/1996 | Rankin, Sr. | B65D 81/3886 206/446 |
| 5,603,363 | A * | 2/1997 | Nelson | B67D 1/07 141/351 |
| 6,237,652 | B1 * | 5/2001 | Nelson | B67C 3/2608 141/18 |
| 6,443,335 | B1 * | 9/2002 | Pinedjian | B67D 1/0006 141/104 |
| 6,669,051 | B1 * | 12/2003 | Phallen | B67C 3/281 222/1 |
| 7,516,623 | B2 * | 4/2009 | Hall, Sr. | B67D 1/0867 62/297 |
| 7,730,912 | B2 | 6/2010 | Blichmann | |
| 2007/0023100 | A1 * | 2/2007 | Blichmann | B67C 3/04 141/18 |
| 2007/0095859 | A1 * | 5/2007 | Maser | B67D 1/04 222/148 |

(Continued)

*Primary Examiner* — Mark A Laurenzi
*Assistant Examiner* — Andrew Schmid
(74) *Attorney, Agent, or Firm* — Kevin K. Thibodeaux

(57) ABSTRACT

In one embodiment, a beverage dispensing system includes a plurality of beverage dispensing devices, and a plurality of beverage hoses, each of the beverage hoses to provide fluid communication between one of the beverage dispensing devices and a beverage source, each of the beverage hoses passing through an aperture formed in a surface. Each of the beverage dispensing devices is movable between an extended position and a retracted position. In the extended position, a beverage dispensing device is moved toward a beverage container and a beverage hose is pulled through the aperture and toward a user-facing side of the surface, the beverage dispensing device adapted to dispense a beverage into the beverage container while in the extended position.

20 Claims, 6 Drawing Sheets

(56) References Cited

U.S. PATENT DOCUMENTS

2007/0204930 A1* 9/2007 Phallen ..... B67D 1/1234 141/83
2008/0251536 A1* 10/2008 Wong ..... B67D 1/04 222/146.6
2008/0308176 A1* 12/2008 Weems ..... B67D 1/04 141/11
2010/0243676 A1* 9/2010 Bax ..... B67D 1/07 222/148
2010/0276452 A1* 11/2010 Vesborg ..... B67D 1/0081 222/144.5
2011/0049182 A1* 3/2011 Smith ..... B67D 1/0406 222/61
2011/0113973 A1* 5/2011 Ishida ..... B67D 1/0071 99/323.1

* cited by examiner

SYSTEMS AND METHODS FOR DISPENSING ONE OR MORE BEVERAGES

CROSS-REFERENCE TO RELATED APPLICATIONS

This application claims the benefit of U.S. Provisional Application No. 61/723,318 filed Nov. 7, 2012, which is hereby incorporated by reference.

TECHNICAL FIELD

The illustrative embodiments relate generally to beverage dispensing systems, and more particularly, to systems and methods for dispensing one or more alcoholic beverages.

BACKGROUND

In settings such as bars, restaurants, and other locations where beverages are served, the system used to dispense beverages is important for a variety of reasons, including customer satisfaction, business efficiency, beverage integrity, etc. For example, when beer is the beverage being dispensed, it may be important to ensure that the beer container is filled in an effective and convenient manner. Also, when dispensing beer into certain types of beer containers, such as beer growlers, it may be important to fill the beer container in a manner that minimizes the beer's exposure to air. Current beverage dispensing systems fail to effectively or efficiently dispense beverages for these and other reasons. Current beverage dispensing systems may also fail to provide suitable sanitation of beverage dispensing devices.

SUMMARY

According to an illustrative embodiment, a beverage dispensing system includes a plurality of beverage dispensing devices, and a plurality of beverage hoses, each of the beverage hoses to provide fluid communication between one of the beverage dispensing devices and a beverage source, each of the beverage hoses passing through an aperture formed in a surface. Each of the beverage dispensing devices is movable between an extended position and a retracted position. In the extended position, a beverage dispensing device is moved toward a beverage container and a beverage hose is pulled through the aperture and toward a user-facing side of the surface, the beverage dispensing device adapted to dispense a beverage into the beverage container while in the extended position.

In another embodiment, a beverage dispensing system includes a plurality of beverage dispensing devices adapted to selectively dispense a beverage and a gas, and a plurality of beverage hoses, each of the beverage hoses to provide fluid communication between one of the beverage dispensing devices and a beverage source, and a plurality of gas hoses, each of the gas hoses to provide fluid communication between one of the beverage dispensing devices and a gas source. Each of the beverage dispensing devices is movable between an extended position and a retracted position. In the extended position, the beverage dispensing device is moved toward a beverage container, the beverage dispensing device adapted to dispense at least one of the gas or the beverage into the beverage container while in the extended position.

In another embodiment, a method for dispensing a beverage includes extending at least one of a plurality of beverage dispensing devices from a surface, the at least one beverage dispensing device coupled to a beverage hose providing fluid communication between the at least one beverage dispensing device and a beverage source, the beverage hose passing through an aperture in the surface, positioning the at least one beverage dispensing device adjacent a beverage container, and dispensing beverage into the beverage container using the beverage dispensing device.

DETAILED DESCRIPTION

In the following detailed description of the illustrative embodiments, reference is made to the accompanying drawings that form a part hereof. These embodiments are described in sufficient detail to enable those skilled in the art to practice the invention, and it is understood that other embodiments may be utilized and that logical structural, mechanical, electrical, and chemical changes may be made without departing from the spirit or scope of the invention. To avoid detail not necessary to enable those skilled in the art to practice the embodiments described herein, the description may omit certain information known to those skilled in the art. The following detailed description is, therefore, not to be taken in a limiting sense, and the scope of the illustrative embodiments are defined only by the appended claims.

Figure 1:
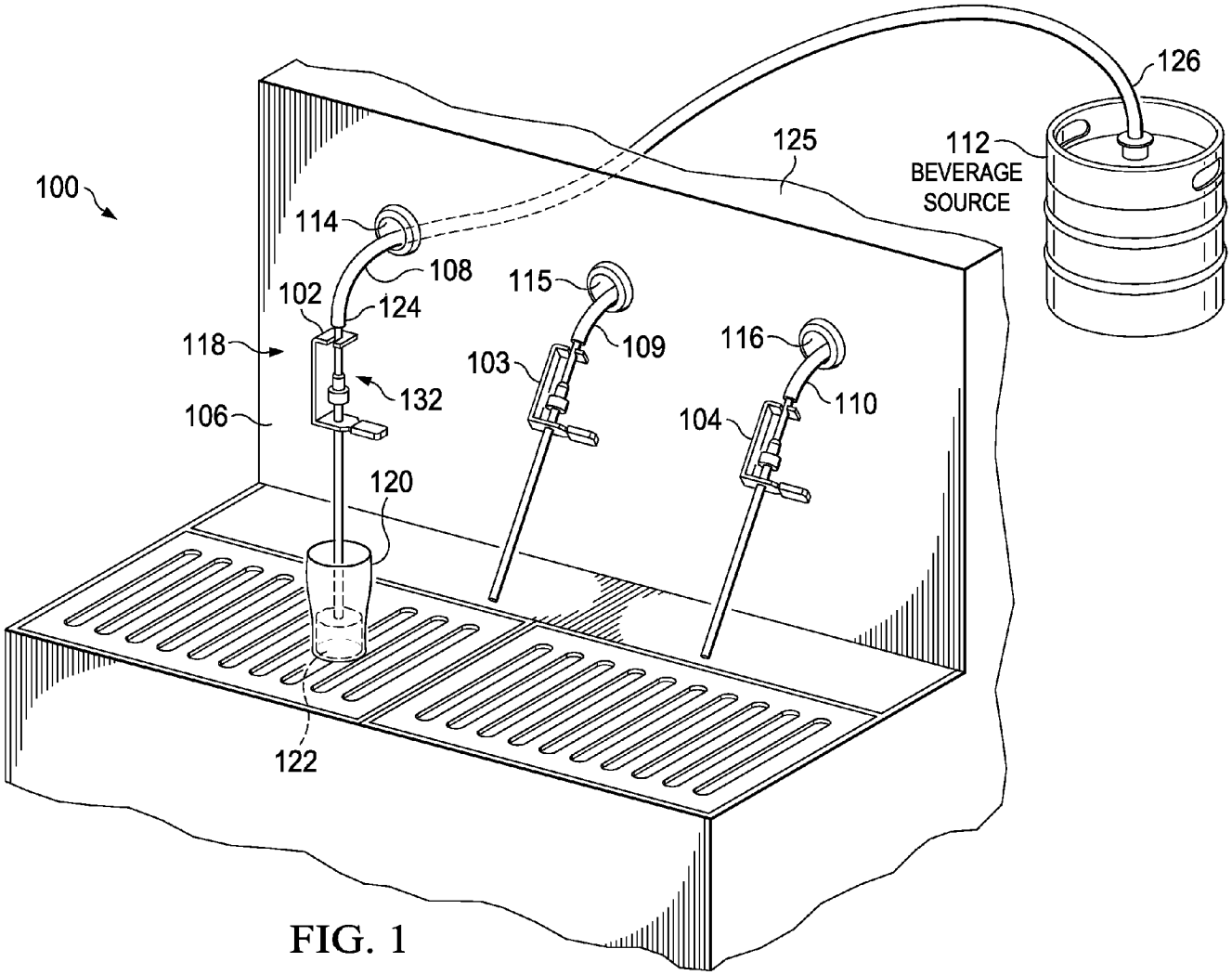
FIG. 1 is a schematic, pictorial representation of a beverage dispensing system in accordance with an illustrative embodiment.
Figure 2:
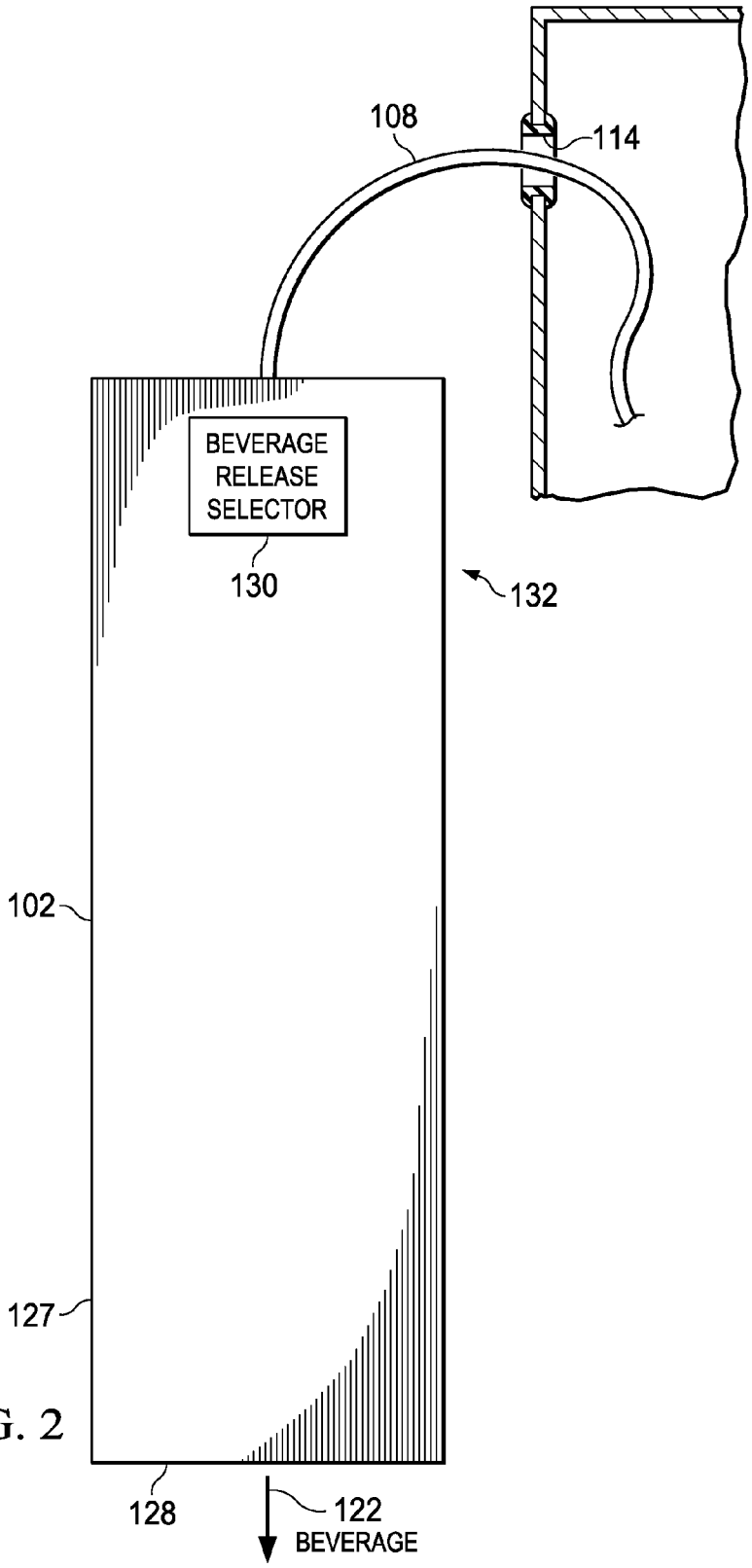
FIG. 2 is a schematic, block diagram of a beverage dispensing device in accordance with an illustrative embodiment.

Referring to FIGS. 1 and 2, an illustrative embodiment of a beverage dispensing system 100 includes beverage dispensing devices 102, 103, 104 that are extendable and retractable out of and into a surface 106. Each of the beverage dispensing devices 102, 103, 104 is coupled to a respective beverage hose 108, 109, 110 that provides fluid communication between each of the beverage dispensing devices 102, 103, 104 and one or more beverage sources 112. Each of the beverage hoses 108, 109, 110 passes through a respective aperture 114, 115, 116 formed in the surface 106. The beverage hoses 108, 109, 110 may move into and out of the respective apertures 114, 115, 116 so as to allow the beverage dispensing devices 102, 103, 104 to be extended and retracted from the surface 106.

The apertures 114, 115, 116 may be any shape or size suitable for allowing any size hose to pass therethrough. The rim forming the apertures 114, 115, 116 may be covered in plastic, rubber, a grommet, or any other material so as to prevent damage to the hoses 108, 109, 110 when the hoses are moved between the extended and retracted positions.

In the example of FIG. 1, the beverage dispensing device 102 has been moved into the extended position, and the beverage dispensing devices 103, 104 are in a retracted position. When moved into the extended position, as the beverage dispensing device 102 has been, the beverage hose 108 is pulled through the aperture and toward the user facing side 118 of the surface 106 so as to move the beverage dispensing device 102 towards a beverage container 120. Once the beverage dispensing device 102 has been moved to the extended position and adjacent the beverage container 120, a beverage 122 may be dispensed into the beverage container 120. After the beverage 122 has been dispensed into the beverage container 120 the beverage hose 108 may be retracted back into the surface 106 through the aperture 114 so as to move the beverage dispensing device 102 towards the surface 106.

The beverage container 120 may be any container capable of holding a fluid, such as a beer growler, bottle, can, mug, cup, flask, case, keg, etc. Also, while three beverage dispensing devices 102, 103, 104 are shown in FIG. 1, any number of beverage dispensing devices may be used to implement the beverage dispensing system 100 (e.g., 1, 6, 10, 20, 30, 50, 72, 100, etc.). For example, only a single beverage dispensing device may be used, as well as a single beverage hose and/or gas hose.

The beverage hose 108 has a first end 124 and a second end 126. The first end 124 is fluidly coupled to the beverage dispensing device 102, while the second end 126 may be coupled to one or more beverage sources 112. Each of the beverage dispensing devices 102, 103, 104 may be fluidly coupled to different beverage sources. For example, in a beer dispensing system, each of the beverage dispensing devices 102, 103, 104 may be fluidly coupled to a different keg or container of beer.

As seen in FIG. 1, different lengths of beverage hose 108, 109, 110 are exposed on the user-facing side 118 of the surface 106 depending on whether the respective beverage dispensing devices 102, 103, 104 are in the extended or retracted position. When one of the beverage dispensing devices 102, 103, 104 is in the extended position, more beverage hose is exposed on the user-facing side 118 of the surface 106 than when the beverage dispensing device is in the retracted position. The additional length of hose exposed to the user-facing side 118 of the surface 106 allows the user to extend the beverage dispensing device 102 toward the beverage container 120 to allow for the beverage container 120 to be filled with the beverage 122. Exposing less of the beverage hose when the beverage dispensing devices 103, 104 are in the retracted position allows the beverage dispensing devices 103, 104 to be out of the way of the user when the beverage dispensing devices 103, 104 are not in use. Because each of the beverage dispensing devices 102, 103, 104 are extendable or retractable at any time by a user, and each of the beverage dispensing devices 102, 103, 104 may be fluidly coupled to a different beverage source, a user may select one of the beverage dispensing devices 102, 103, 104 based on the desired beverage to be dispensed, and extend the beverage dispensing device associated with the desired beverage from the surface 106 and toward the beverage container 120 so that the beverage container 120 may be filled with the desired beverage. Also, more than one of the beverage dispensing devices 102, 103, 104 may be in the extended position at any given time. For example, a person or persons may extend more than one of the beverage dispensing devices 102, 103, 104 at a given time in order to fill more than one beverage container at a time. Thus, the illustrative embodiments allow for the convenient selection of a beverage out of a selection of multiple beverages.

In one embodiment, the surface 106 may be a wall that provides full or partial separation from the space at which the beverage dispensing devices 102, 103, 104 are located. In another embodiment, the surface 106 may be a wall, ceiling, or countertop. In one non-limiting example, the surface 106 may be one of a plurality of walls forming a cooler 124. In this example, the one or more beverage sources 112 may be located within the cooler 124. Also, the apertures 114, 115, 116 may provide a space within which the beverage hoses 108, 109, 110 are movable into and out of the cooler 124.

In another embodiment, the cooler 124 may be remote from the area at which the beverage dispensing devices 102, 103, 104 are located. For example, the beverage dispensing system 100 is compatible for use in a glycol-based beer dispensing system in which glycol is used to cool beer over certain distances. In this embodiment, the beverage hoses 108, 109, 110 may extend relatively larger distances to reach a remote cooler any distance away (e.g., 30 feet, 50 feet, 200 feet, etc.).

In one embodiment, one or more of the apertures 114, 115, 116 may be at least partially covered by an air flow restriction barrier to reduce air flow through the apertures 114, 115, 116. Any type of material may be used as the air flow restriction barriers, such as flexible flaps or fins, grommets, corks or stoppers, etc. For example, one or more rubber flaps may be located at each of the apertures 114, 115, 116 to allow for movement of the beverage hoses 108, 109, 110, yet still restrict at least some of the airflow through the apertures 114, 115, 116. In yet another example, a stopper may be coupled onto one or more of the beverage hoses 108, 109, 110 such that the stopper at least partially fills the respective aperture 114, 115, 116 when the beverage dispensing devices 102, 103, 104 are in the retracted position.

Referring specifically to FIG. 2, the beverage dispensing device 102 may include a stem portion 127 that may be inserted into the beverage container 120 when the beverage dispensing device 102 is in an extended position. The beverage 122 may be dispensed into the beverage container 120 while the stem portion 127 is inserted into the beverage container 120. In one non-limiting example, more than half of the stem portion 127 may be inserted into the beverage container 120 while the beverage 122 is dispensed into the beverage container 120. The stem portion 127 may also comprise a dispensing end 128 from which the beverage 122 may be dispensed; in this example, dispensing end 128 may be adapted to be adjacent the bottom of the beverage container 120 while the beverage 122 is dispensed into the beverage container 120. However, in other embodiments, the dispensing end 128 of the beverage dispensing device 102 need not be adjacent the bottom of the beverage container 120 while the beverage 122 is dispensed into the beverage container 120, and need not be submerged at all in the beverage as the beverage is being dispensed.

The beverage dispensing device 102 may also include a beverage release selector 130 that may be selected to release the beverage 122 from the beverage dispensing device 102. The beverage release selector 130 may be a button, trigger, digital input, or any other mechanism by which a user may cause the beverage 122 to be dispensed from the beverage dispensing device 102. In some non-limiting examples, the beverage may be pushed out of the beverage dispensing device 102 when the beverage release selector 130 is selected using a motivating force such as gas pressure, including carbon dioxide, nitrogen, argon, or any combination there.

The beverage dispensing device 102 may also include a grip portion 132. The user may grasp the grip portion 132 to move the beverage dispensing device 102 between the extended and retracted positions.

In operation, a user may select one of the beverage dispensing devices 102, 103, 104 and extend the selected beverage dispensing device from the surface 106. The user may then position the extended beverage dispensing device adjacent the beverage container 120. The user may then dispense the beverage 122 into the beverage container 120 using the extended beverage dispensing device. In positioning the beverage dispensing device adjacent the beverage container 120, the stem portion 127 of the beverage dispensing device may be inserted into the beverage container 120. After the user has dispensed the beverage 122 in the beverage container 120, the beverage dispensing device may be retracted back toward the surface 106.

In placing the beverage dispensing device "adjacent" the beverage container 120, the beverage dispensing device may be placed anywhere relative to the beverage container 120 that allows the beverage to move into the beverage container 120. As mentioned above, this may include inserting the stem portion 127 fully or partially into the beverage container 120. This may also include holding the beverage dispensing device near the top, or open, portion of the beverage container 120. As can be seen from these examples, the term "adjacent" is meant to be construed broadly in this context to include many different positions at which the beverage may be dispensed.

The beverage dispensing devices 102, 103, 104 may be manually extended and retracted from the surface 106. In yet another embodiment, each of the beverage hoses 108, 109, 110 may be slidably or movably coupled to a respective hose retraction device that biases the beverage hoses 108, 109, 110 and beverage dispensing devices 102, 103, 104 into the retracted position. Movement of the beverage dispensing devices 102, 103, 104 between the extended and retracted positions may be achieved using motorized devices.

In another embodiment, the beverage hoses 108, 109, 110 do not retract and extend within the apertures 114, 115, 116, and the beverage dispensing devices 102, 103, 104 remain substantially stationary when in use to dispense a beverage and when not in use. In one example of this embodiment, a beverage container may be moved toward the substantially stationary position of one of the beverage dispensing devices 102, 103, 104 so that the beverage may be dispensed into the beverage container. In this embodiment, the beverage dispensing system 100 may lack apertures 114, 115, 116 through which the beverage hoses 108, 109, 110 are movable, such that a pre-determined amount of each beverage hoses 108, 109, 110 is non-changeably exposed on the user-facing side 118 of the surface 106. This fixed amount of exposed beverage hose may be long enough to allow maneuverability of the beverage dispensing device(s) to fill a beverage container.

In another embodiment, the apertures 114, 115, 116 may be formed from pipes or channels that extend through a wall or surface. For example, the apertures 114, 115, 116 may be PVC tubes that extend through the wall of a walk-in cooler or other wall. However, the apertures 114, 115, 116 may be any type or shape of hole formed in any manner.

In another embodiment, at least a portion of the beverage dispensing devices 102, 103, 104 may be insertable in the apertures 114, 115, 116 or into the surface 106 when in the retracted position. In another embodiment, at least a portion of the beverage dispensing devices 102, 103, 104 may be inserted into the cooler 125 when in the retracted position. In the embodiment in which the beverage dispensing devices 102, 103, 104 are substantially stationary and do not move between extended and retracted positions, the beverage dispensing devices 102, 103, 104 may be positioned at least partially in the apertures 114, 115, 116 or the cooler 125.

In another embodiment, a monitoring mechanism may be used to monitor the amount of beverage poured from each of the beverage dispensing devices 102, 103, 104. Such a monitoring system may include a fluid flow meter operatively coupled to one or more of the beverage hoses 108, 109, 110 or the beverage dispensing devices 102, 103, 104.

Figure 3:
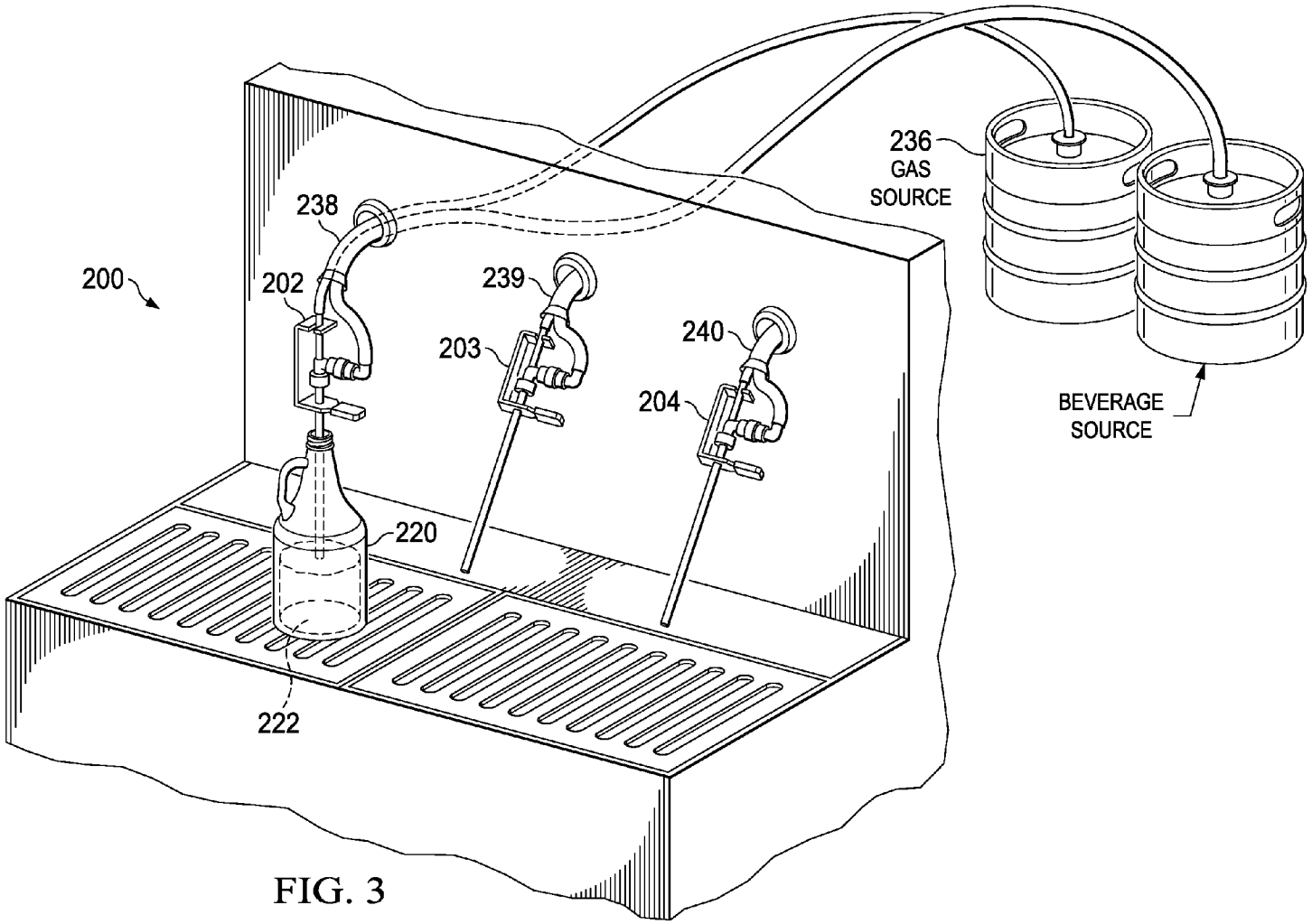
FIG. 3 is a schematic, pictorial representation of a beverage dispensing system capable of dispensing a beverage or gas in accordance with an illustrative embodiment.
Figure 4:
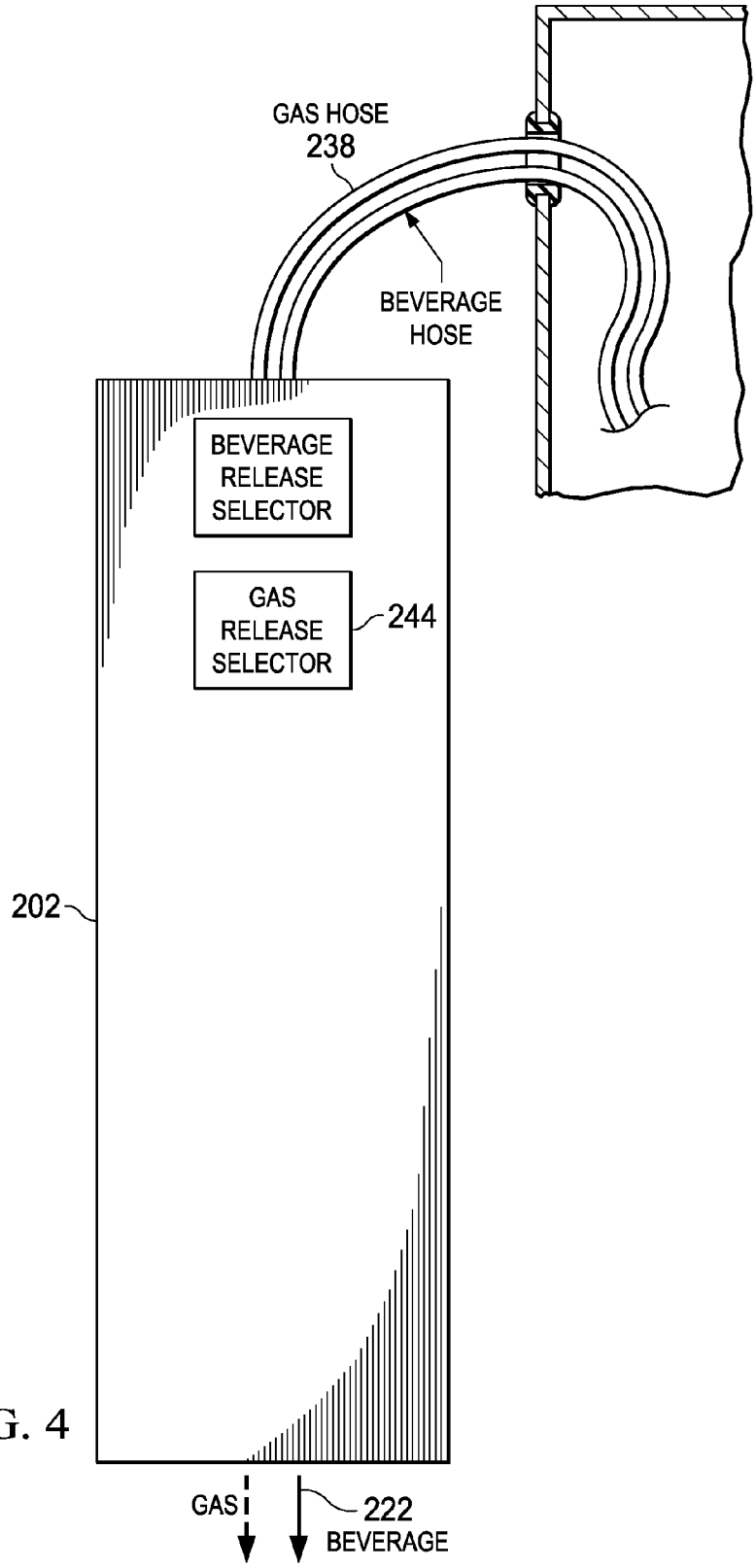
FIG. 4 is a schematic, block diagram of a beverage dispensing device for dispensing a beverage or gas in accordance with an illustrative embodiment.

Referring to FIGS. 3 and 4, an illustrative embodiment of the beverage dispensing system 200 includes the beverage dispensing devices 202, 203, 204 that are capable of dispensing both a gas and the beverage 222. Elements of FIGS. 3 and 4 that are analogous to elements in FIGS. 1 and 2 have been shown by indexing the reference numerals by 100.

In the embodiment of FIGS. 3 and 4, each of the beverage dispensing devices 202, 203, 204 may also dispense a gas from one or more gas sources 236. Each of the beverage dispensing devices 202, 203, 204 is fluidly coupled to a respective gas 238, 239, 240. In a manner similar to that described in FIGS. 1 and 2, both the beverage and gas hoses may be retracted into and out of respective apertures to allow the beverage dispensing devices 202, 203, 204 to be moved between an extended and retracted position.

The beverage hose and gas hose for each respective beverage dispensing device may be coupled to one another in a variety of ways. For example, the beverage hose and gas hose may be at least partially encased in a tape, mold, or other material, such as shrinkable Teflon. The beverage hose and gas hose may also be individual lumens, or ducts, of a single hose. In another example, a hose may have an inner lumen and a circumferential, outer lumen (a hose within a hose) to allow for the passage of both a beverage and gas (one pathway for gas, and the other for a beverage). In yet another embodiment, the beverage hose and gas hose may not be coupled to one another at all. In yet another embodiment, instead of two hoses, both the gas and the beverage may be selectively dispensed through the same hose.

The gas source 236 may be any container or device capable of storing and/or delivering a gas, including, but not limited to, a carbon dioxide tank, a nitrogen tank, a nitrogen generator, a carbon dioxide generator, any combination of these, etc.

In another embodiment, a gas source 236 may be in each of the beverage dispensing devices 202, 203, 204. For example, each of the beverage dispensing devices 202, 203, 204 may include a carbon dioxide cartridge from which carbon dioxide may be dispensed into the beverage container in the manner described.

When utilizing this embodiment, the beverage dispensing device 202 may be moved adjacent the beverage container 220 by moving the beverage dispensing device 202 into the extended position. Before dispensing the beverage 222 into the beverage container 220, a gas, such as carbon dioxide or nitrogen, may be dispensed into the beverage container 220. The gas may be dispensed from the beverage dispensing device 202 using a gas release selector 244, which may be a button, trigger, digital input, or any other mechanism that causes gas to be released from the beverage dispensing device 202. After the beverage container 220 has been fully or partially filled with the gas, the beverage 222 may be dispensed into the beverage container 220 using the beverage dispensing device 202.

The embodiment of FIGS. 3 and 4 may be useful in a large variety of beverage dispensing scenarios. For example, when filling beer growlers or containers, the injection of gas, such as carbon dioxide, into the beer container before dispensing beer into the beer container may help to prevent or reduce contact of the beer with air, thereby helping to preserve the freshness of the beer within the beer container. Such beer containers may be sealed after being injected with gas and/or beer so as to allow for transport and/or preservation of the beer after filling.

It will be appreciated that the beverages able to dispensed by the beverage dispensing system 100 are numerous, including, but not limited to, any carbonated beverage (e.g., beer, kombucha, soda, carbonated water, etc.), any alcoholic beverage (liquor, wine, beer, pre-mixed drinks, etc.), or any other drinkable liquid.

The gas hoses 238, 239, 240 may each transmit the same or different pressures of gas. In another embodiment, a monitoring mechanism may be used to monitor the amount of gas dispensed from each of the beverage dispensing devices 202, 203, 204.

Figure 5:
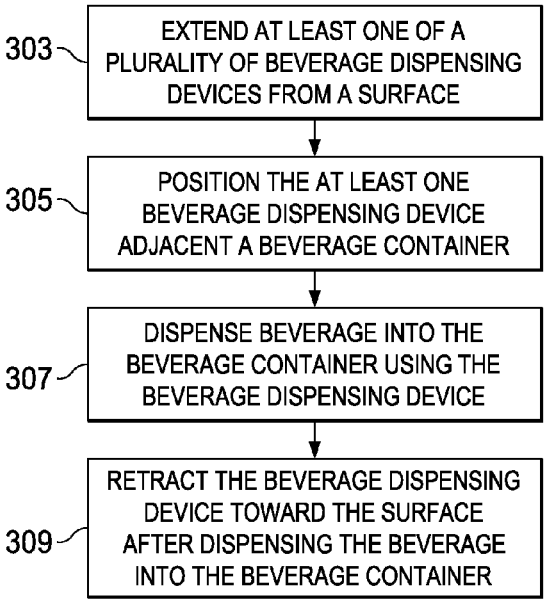
FIG. 5 is a flowchart of a process for dispensing a beverage in accordance with an illustrative embodiment.

Referring to FIG. 5, a process for dispensing a beverage may include extending at least one of a plurality of beverage dispensing devices from a surface (step 303). The process may also include positioning the at least one beverage dispensing device adjacent a beverage container (step 305). The process may also include dispensing beverage into the beverage container using the beverage dispensing device (step 307). The process may also include retracting the beverage dispensing device toward the surface after dispensing beverage into the beverage container (step 309).

Figure 6:
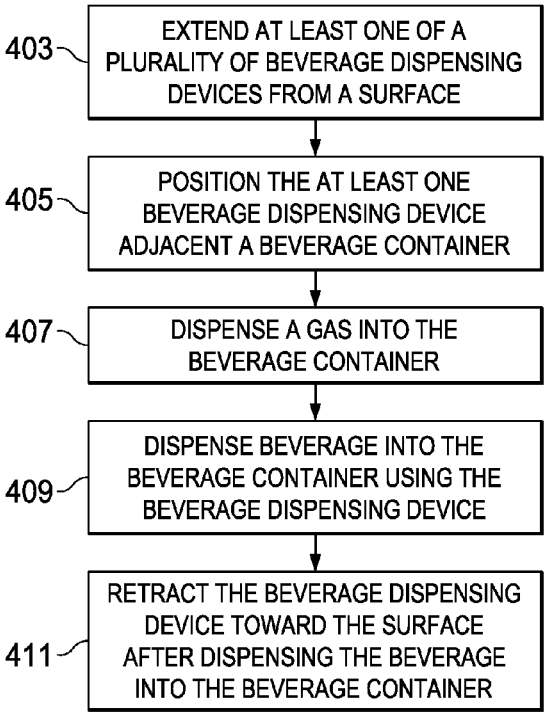
FIG. 6 is a flowchart of a process for dispensing a beverage and a gas in accordance with an illustrative embodiment.

Referring to FIG. 6, a process for dispensing a beverage includes extending at least one of the plurality of beverage dispensing devices from a surface (step 403). The process may include positioning the at least one beverage dispensing device adjacent a beverage container (step 405). The process may include dispensing a gas into the beverage container (step 407). The process may also include dispensing a beverage into the beverage container using the beverage dispensing device (step 409). The process may also include retracting the beverage dispensing device toward the surface after dispensing the beverage into the beverage container (step 411).

The flowcharts and block diagrams in the different depicted embodiments illustrate the architecture, functionality, and operation of some possible implementations of apparatus, methods and computer program products. In this regard, each block in the flowchart or block diagrams may represent a module, segment, or portion of code, which comprises one or more executable instructions for implementing the specified function or functions. In some alternative implementations, the function or functions noted in the block may occur out of the order noted in the Figures. For example, in some cases, two blocks shown in succession may be executed substantially concurrently, or the blocks may sometimes be executed in the reverse order, depending upon the functionality involved.

Figure 7:
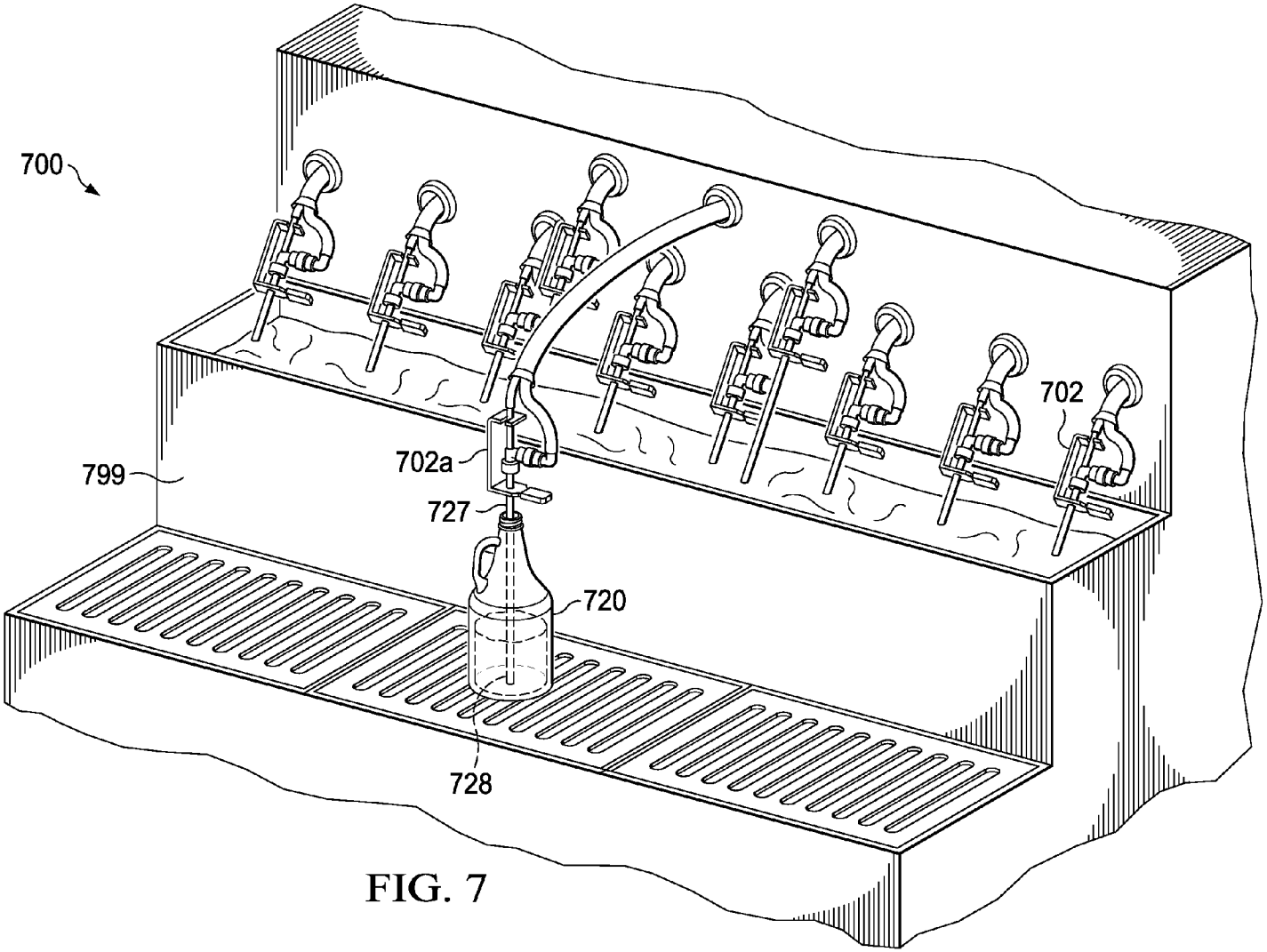
FIG. 7 is a schematic, perspective view of a beverage dispensing system in accordance with an illustrative embodiment.

Referring to FIG. 7, an illustrative embodiment of a beverage dispensing system 700 includes a plurality of beer dispensing devices 702. Beer dispensing device 702*a* is shown in the extended position, while the remaining beer dispensing devices are shown in the retracted position. The stem 727 of beer dispensing device 702*a* is shown to be inserted into a beer growler 720 such that the dispensing end 728 of the beer dispensing device 702*a* is adjacent the bottom of the beer growler 720. In this example, the beer growler 720 may also be any sealable or non-sealable container. In another embodiment, a beer glass may also be used. The beverage dispensing system 700 also includes a sanitation tray 799. When a beer dispensing device is in the retracted position, the stem portion of the beer dispensing device may be at least partially submerged in a liquid contained in the sanitation tray 799. The liquid may be water, sanitizer, or any other liquid for rinsing or cleaning the stem portion of the beer dispensing device. By submerging the stem portion of the beer dispensing device in this manner, the stem portion may be kept sanitized or rinsed when in the retracted position. Such rinsing/sanitizing may be useful to reduce odors or contamination sometimes found in other beverage, including beer, dispensing systems.

Unless otherwise indicated, as used herein, "or" does not require mutual exclusivity.

As used herein, the term "coupled" may include coupling via a separate object and may also include direct coupling. The term "coupled" may also encompass two or more components that are continuous with one another by virtue of each of the components being formed from the same piece of material. Also, the term "coupled" may include chemical, such as via a chemical bond, mechanical, thermal, magnetic, or electrical coupling.

Although the illustrative embodiments described herein have been disclosed in the context of certain illustrative, non-limiting embodiments, it should be understood that various changes, substitutions, permutations, and alterations can be made without departing from the scope of the invention as defined by the appended claims. It will be appreciated that any feature that is described in a connection to any one embodiment may also be applicable to any other embodiment.

What is claimed is:

1. A beverage dispensing system comprising:

a plurality of beverage dispensing devices; and a plurality of beverage hoses, each of the beverage hoses to provide fluid communication between one of the beverage dispensing devices and a beverage source, each of the beverage hoses passing through an aperture formed in a surface, the beverage source located in a cooler;

wherein at least a portion of each of the plurality of beverage hoses is cooled;

wherein each of the plurality of beverage hoses is movable, through the aperture, between an extended position and a retracted position; and wherein, in the extended position, a beverage dispensing device is moved toward a beverage container and a beverage hose is pulled through the aperture and toward a user-facing side of the surface, the beverage dispensing device adapted to dispense a beverage into the beverage container while in the extended position.

2. The beverage dispensing system of claim 1, wherein, in the retracted position, the beverage hose is retracted into the aperture such that the beverage dispensing device is moved toward the surface.

3. The beverage dispensing system of claim 1, wherein the surface is one of a plurality of walls forming the cooler; and wherein the aperture provides a space within which the beverage hose is movable into and out of the cooler.

4. The beverage dispensing system of claim 1, wherein, in the extended position, a first length of beverage hose is exposed on the user-facing side of the surface;

wherein, in the retracted position, a second length of beverage hose is exposed on the user-facing side of the surface; and wherein the first length is longer than the second length.

5. The beverage dispensing system of claim 1, wherein each of the beverage hoses has a first end and a second end, the first end of each of the beverage hoses coupled to one of the beverage dispensing devices, the second end of each of the beverage hoses coupled to one of a plurality of beverage dispensing sources.

6. The beverage dispensing system of claim 1, wherein the beverage dispensing device comprises a stem portion adapted to be inserted into the beverage container while the beverage dispensing device is in the extended position, the beverage to be dispensed into the beverage container while the stem portion is at least partially inserted into the beverage container.

7. The beverage dispensing system of claim 6, wherein the stem portion comprises a dispensing end from which the beverage is dispensed, the dispensing end adapted to be adjacent the bottom of the beverage container while the beverage is dispensed into the beverage container.

8. The beverage dispensing system of claim 1, wherein the beverage dispensing device comprises a beverage release selector, the beverage to be dispensed from the beverage dispensing device when the beverage release selector is selected.

9. The beverage dispensing system of claim 1, wherein the beverage dispensing device is adapted to dispense beer, and the beverage source is a beer keg.

10. The beverage dispensing system of claim 1, wherein at least one of the beverage dispensing devices is further adapted to dispense a gas, the system further comprising:

at least one gas hose, each of the at least one gas hoses to provide fluid communication between one of the beverage dispensing devices and a gas source.

11. The beverage dispensing system of claim 10, wherein the gas is adapted to be dispensed into the beverage container prior to dispensing the beverage into the beverage container.

12. A beverage dispensing system comprising:

a plurality of beverage dispensing devices adapted to selectively dispense a beverage and a gas;

a plurality of beverage hoses, each of the beverage hoses to provide fluid communication between one of the beverage dispensing devices and one or more beverage sources, the one or more beverage sources located in a cooler; and a plurality of gas hoses, each of the gas hoses to provide fluid communication between one of the beverage dispensing devices and one or more gas sources;

wherein at least a portion of each of the plurality of beverage hoses is cooled;

wherein each of the plurality of beverage hoses is movable, through an aperture in a surface, between an extended position and a retracted position; and wherein, in the extended position, the beverage dispensing device is movable toward a beverage container, the beverage dispensing device adapted to dispense at least one of the gas or the beverage into the beverage container while in the extended position.

13. The beverage dispensing system of claim 12, wherein the beverage dispensing devices are retracted toward the surface when in the retracted position, the surface forming one of more apertures through which the beverage hoses and the gas hoses are movable.

14. The beverage dispensing system of claim 12, wherein the gas is dispensed into the beverage container prior to dispensing the beverage into the beverage container such that the beverage container is at least partially filled with the gas prior to the beverage being dispensed into the beverage container.

15. A method for dispensing a beverage comprising:

extending at least one of a plurality of beverage dispensing devices away from a surface, the at least one beverage dispensing device coupled to a beverage hose providing fluid communication between the at least one beverage dispensing device and a beverage source, the beverage hose passing through an aperture in the surface, the beverage source located in a cooler;

positioning the at least one beverage dispensing device adjacent a beverage container; and dispensing beverage into the beverage container using the beverage dispensing device;

wherein at least a portion of the beverage hose is cooled; and wherein the beverage hose is movable, through the aperture, between an extended position and a retracted position.

16. The method of claim 15, further comprising:

retracting the beverage dispensing device toward the surface after dispensing the beverage into the beverage container.

17. The method of claim 15, further comprising:

dispensing a gas into the beverage container prior to dispensing the beverage into the beverage container.

18. The beverage dispensing system of claim 1, further comprising:

a sanitation tray adapted to contain a liquid, at least a portion of at least one of the plurality of beverage dispensing devices adapted to be submerged in the liquid when the at least one of the plurality of beverage dispensing devices is in the retracted position.

19. The beverage dispensing system of claim 1, wherein the surface is a cooler wall.

20. The beverage dispensing system of claim 4, wherein at least a portion of the first length of beverage hose is cooled when the beverage hose is in the retracted position.

* * * * *